US010022286B2

(12) United States Patent
Marshall

(10) Patent No.: US 10,022,286 B2
(45) Date of Patent: Jul. 17, 2018

(54) BEDPAN SYSTEM

(71) Applicant: Michelle Marshall, Miami, FL (US)

(72) Inventor: Michelle Marshall, Miami, FL (US)

( * ) Notice: Subject to any disclaimer, the term of this patent is extended or adjusted under 35 U.S.C. 154(b) by 0 days.

(21) Appl. No.: 15/052,588

(22) Filed: Feb. 24, 2016

(65) Prior Publication Data

US 2017/0239117 A1 Aug. 24, 2017

(51) Int. Cl.
*A61G 9/00* (2006.01)

(52) U.S. Cl.
CPC ..... *A61G 9/003* (2013.01); *A61G 2203/44* (2013.01)

(58) Field of Classification Search
CPC ..... A61G 9/003; A61G 9/006; A61G 9/00
See application file for complete search history.

(56) References Cited

U.S. PATENT DOCUMENTS

| | | | | |
|---|---|---|---|---|
| 7,891,030 | B1 * | 2/2011 | Sutton | A47K 11/06 4/483 |
| 8,303,554 | B2 * | 11/2012 | Tsai | A61B 5/445 604/317 |
| 2011/0185489 | A1 * | 8/2011 | Partington | A61G 9/003 4/450 |
| 2014/0082832 | A1 * | 3/2014 | Marshall | A61G 9/003 4/452 |

* cited by examiner

*Primary Examiner* — Janie Loeppke
(74) *Attorney, Agent, or Firm* — Johnson | Dalal; Mark C. Johnson

(57) ABSTRACT

A bedpan system including an anatomically configured assembly, an inner liner, and at least one sensor positioned within said liner to actuate at least one device.

9 Claims, 12 Drawing Sheets

BEDPAN SYSTEM

BACKGROUND OF THE INVENTION

The bedpan is a very commonly utilized piece of medical equipment. However, short of a physical examination of the bedpan or a specific request that a bedpan is needing to be changed, a medical caregiver has no indication as to the need to change a particular bedpan. The present invention addresses this need.

SUMMARY OF THE INVENTION

The system of the present invention provides significant improvements not found or discussed anywhere. Because there are alerts provided, in a clinical setting, ulcers, infections, and decreased perfusion are all positive results when in use. Patients post surgery, spinal cord and back injury patients, unresponsive/unconscious patients, and mental patients will all benefit from this system.

In one embodiment, the present invention is a bedpan assembly comprising: a main housing having an interior cavity; a liner assembly having an interior cavity; a sensor assembly including at least one sensor; and at least one indicator operatively associated with said sensor.

In one embodiment, the assembly is constructed wherein said main housing has a rear elevation angle of about 6-10 degree, a front edge degree of curvature between about 30-40 degrees, and a non-curved surface immediately adjacent to said front end degree of curvature with an elevation of about 5-10 mm and free of any curvature.

In one embodiment, the sensor is operatively associated to actuate at least one indicator.

In one embodiment, the indicator is at least one of a visual indicator, an audio indicator, or combinations thereof.

In one embodiment, the sensor is operatively associated with at least one transmission device that is paired with at least one receiver configured for indicating said sensor being actuated.

In one embodiment, the sensor is at least one of a weight sensor, a liquid sensor, a quantitative chemical sensor, or combinations thereof.

In one embodiment, the assembly includes a removable assembly placed within an interior cavity of said housing.

In one embodiment, the assembly includes a pair of length edge bay structures congruently positioned along opposing lengths of said housing.

In one embodiment, each of said pair of length edge bay structures is constructed to form an angle between about 70 to 80 degrees.

In one embodiment, the assembly includes a rear bay structure having a width between about 90-100 mm.

In one embodiment, the housing has a width between about 300-360 mm.

In one embodiment, the present invention is a bedpan system consisting essentially of:

a main housing having an interior cavity, said main housing constructed and arranged with a rear elevation angle of about 6-10 degree measured from a tangent line extending outward from a final rear point of said assembly, with an upper surface profile having a rear upward curvature, a front edge degree of curvature between about 30-40 degrees, and a non-curved surface between and immediately adjacent to said front end degree of downward curvature and said rear upward curvature, said noncurvature surface with an elevation of about 5-10 mm and free of any curvature, whereby the ratio of the linear distance of said front end downward curvature: non-curved surface: rear upward curvature is about 1:0.9-1.1:4.8-5.2; a liner assembly having an interior cavity configured for placement and removal from said housing cavity;

a sensor assembly including at least one sensor selected from the group consisting of a weight sensor, a liquid sensor, a quantitative chemical sensor, or combinations thereof;

at least one indicator actuatable by said sensor and selected from the group consisting of a light indicator, a sound indicator, a transmitter associated with a remote receiver, or combinations thereof, wherein said indicator is controlled by a PCB board configured for actuating said indicator at the command of said sensor;

a pair of length edge bay structures formed on and congruently positioned along opposing lengths of said housing, wherein each of said pair of length edge bay structures is constructed to form an angle between about 70 to 80 degrees;

a rear bay structure having a width between about 90-100 mm; and wherein said housing has a width between about 300-360 mm.

DETAILED DESCRIPTION OF THE PREFERRED EMBODIMENTS

Figure 1:
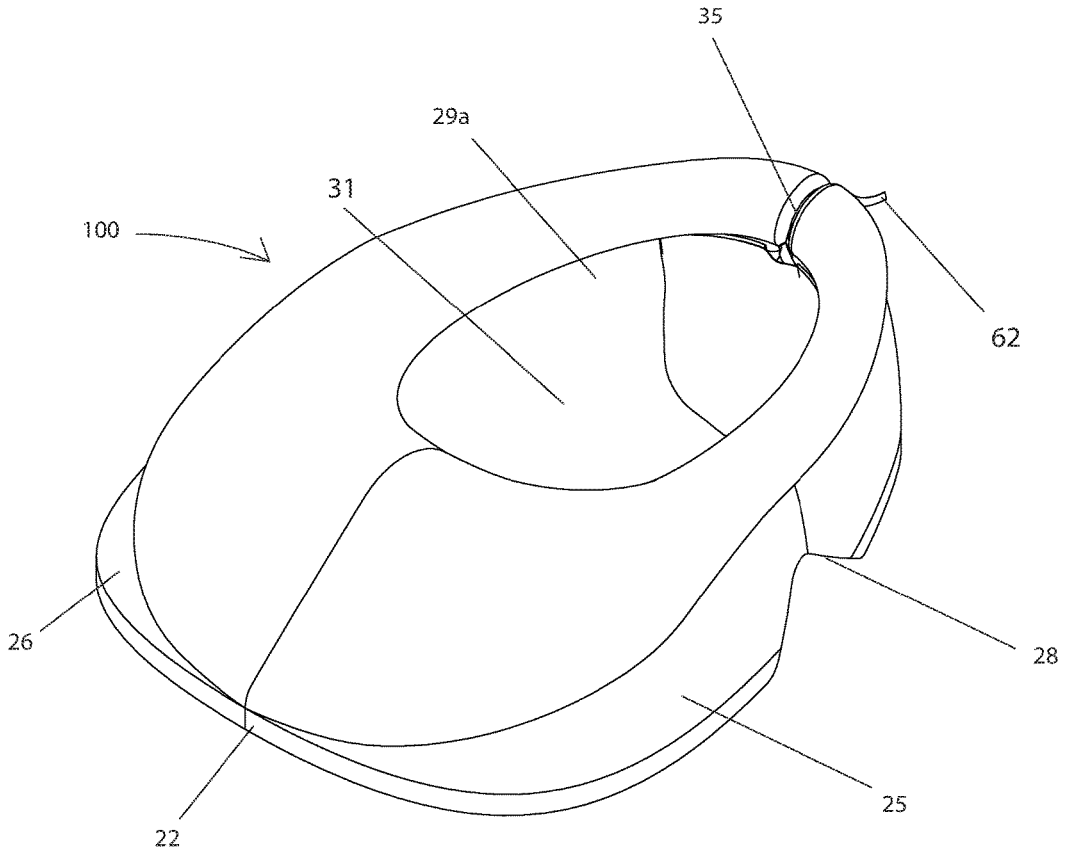
FIG. 1 is a perspective view according to one embodiment of the present invention.
Figure 2:
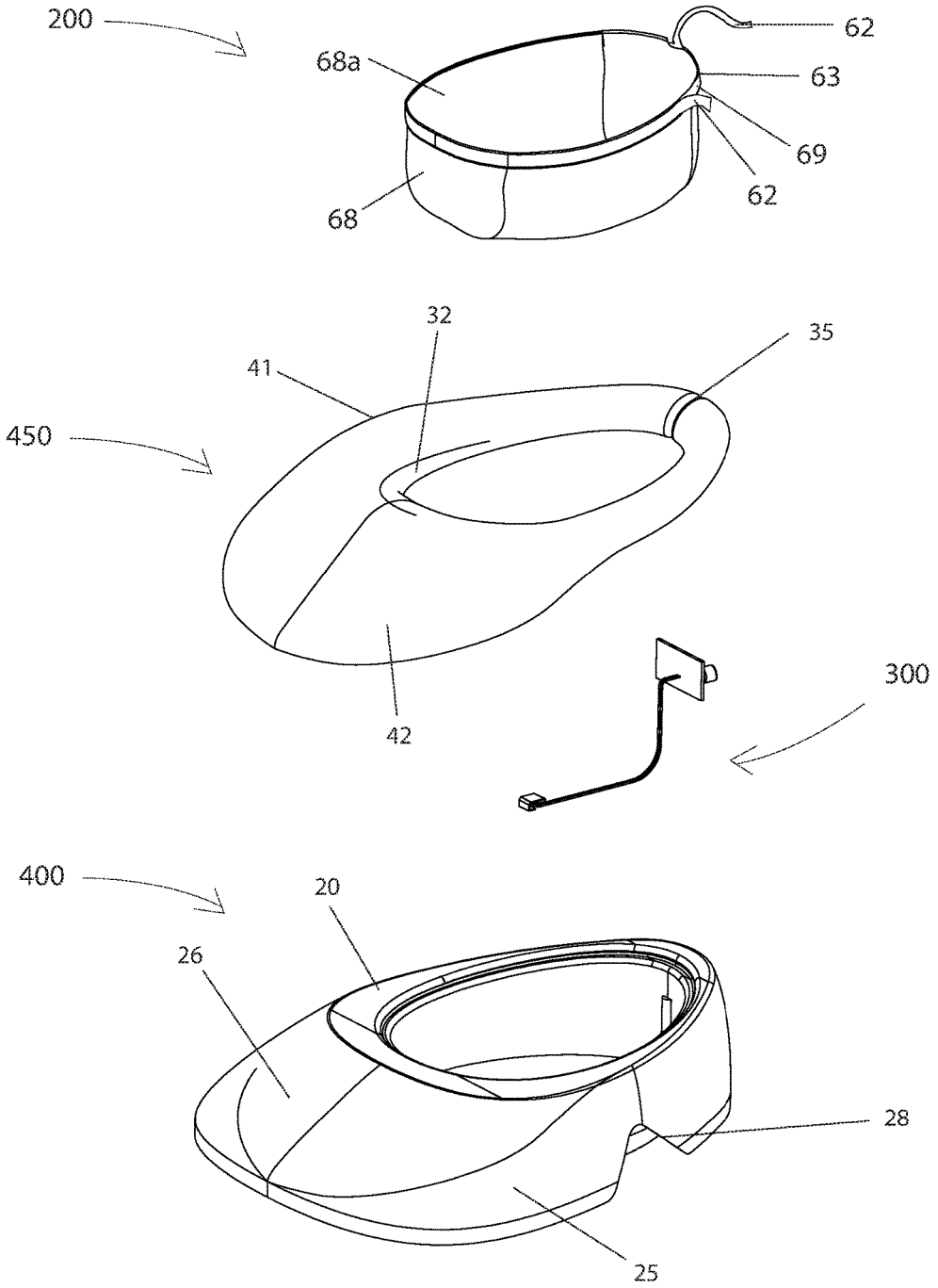
FIG. 2 is a perspective separated view demonstrative of separated components according to one embodiment of the present invention.
Figure 3:
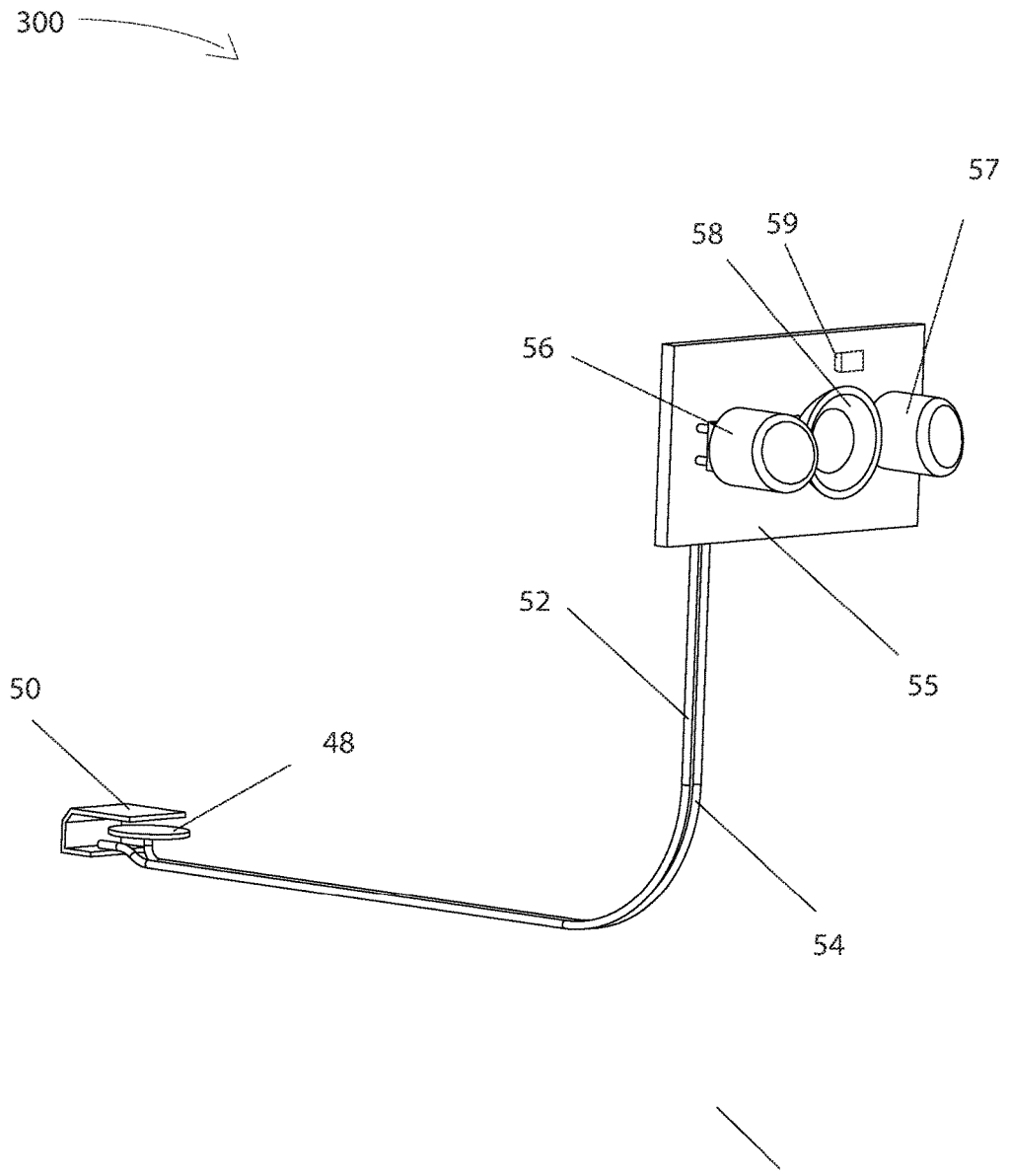
FIG. 3 is a perspective view of the sensor component according to one embodiment of the present invention.

The present invention relates in general to a novel bedpan system. All medical professionals that utilize bedpans in the course of their profession will tell you there are often deficiencies that prevent for the efficient use of using a bedpan. In one embodiment, bedpan assembly 100 includes a main housing 20, having a front end 22, a side wall 25, upper wall 26, bottom wall 27, bay structure 28, constructed and arranged around a main opening 30. Main opening 30 in general is defined by rim 32 and provides access to internal cavity 31.

Figure 4:
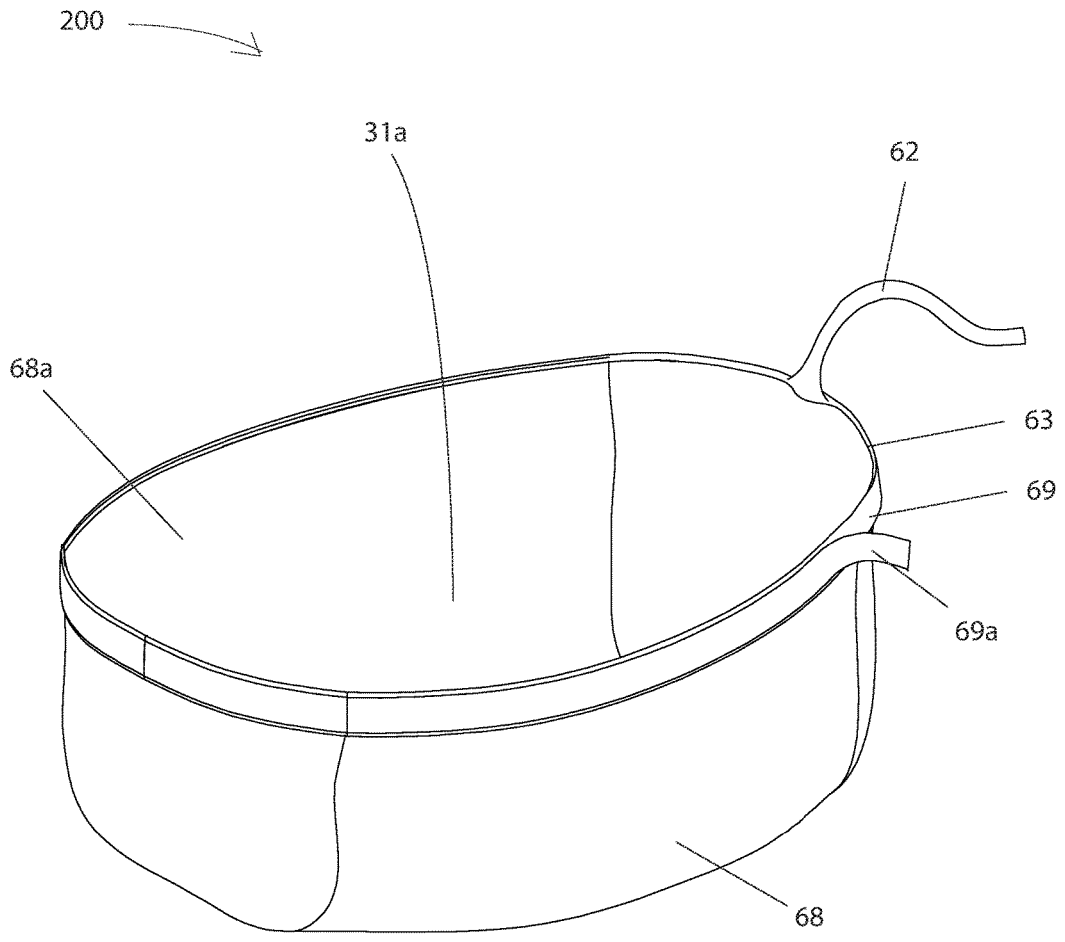
FIG. 4 is a perspective view of the liner assembly according to one embodiment of the present invention.

In one embodiment, as best demonstrated in FIG. 4, liner assembly 200 includes an internal liner having an outer surface 68, inner surface 68*a* and access opening 63 to access the internal cavity of liner assembly 31*a*.

In one embodiment, liner assembly 200 is constructed and arranged of a flexible material, including but not limited to, plastics, polymers, combinations thereof, and the like. Liner guide 62 is constructed and arranged, as demonstrated in FIG. 1 and FIG. 4, for positioning liner assembly 200 within main assembly inner cavity 31*a* and removal as needed.

In one embodiment, sensor assembly 300 is utilized in the present invention. Sensor assembly 300 includes at least one of indicator light 56, speaker 58, or combinations thereof. PCB board 55 includes a power actuator 57 to provide power to sensor assembly 300. Positive cable 52 and negative cable 54 connect PCB board 55 with sensor 48 that is positioned within sensor protector assembly 50. In one embodiment, sensor 48 is a weight sensor and actuates either or both of light 56 and speaker 58 to alert that a certain weight threshold has been met. For example, when a specific amount of urine and/or feces is present such that weight sensor 48 is actuated, sensor assembly 300 will indicate either by light, sound, or both, that there is an actuating weight of liquid and/or solid present in the bedpan assembly system of the present invention. As such, the sensor assembly 300 is operable to detect the presence of a weight of the fluid on the bottom wall of the liner assembly 200, whereby the actuation of either the sound or light provides a user an indication for removal of the liner assembly 200 by uncoupling the liner assembly from the main housing 20. Additionally, as seen best in FIG. 5, the receiving access member 62 has a first end coupled to the upper edge of the flexible liner assembly 200, a second free end, opposing the first end, and a receiving access member length separating the first and second ends. The receiving access member 62 is disposed within the interface 35 of the cushion assembly 450 along the receiving access member length and the second free end of the receiving access member protruding from the cushion assembly for grasping by a user.

In one embodiment, sensor 48 includes one or more sensors constructed and arranged to actuate light and/or sound indicators based on weight, presence of liquid and/or feces, chemical composition, and combinations thereof. In one embodiment, sensor 48 is a chemical sensor that actuates when a particular chemical threshold is met. As is known, urine includes components of water, urea, uric acid, chloride, sodium, potassium, and creatinine. Sensor 48, in one embodiment, not only senses the presence of liquid, but can sound a particularized alert relating to an abnormal chemical composition of the urine.

Figure 5:
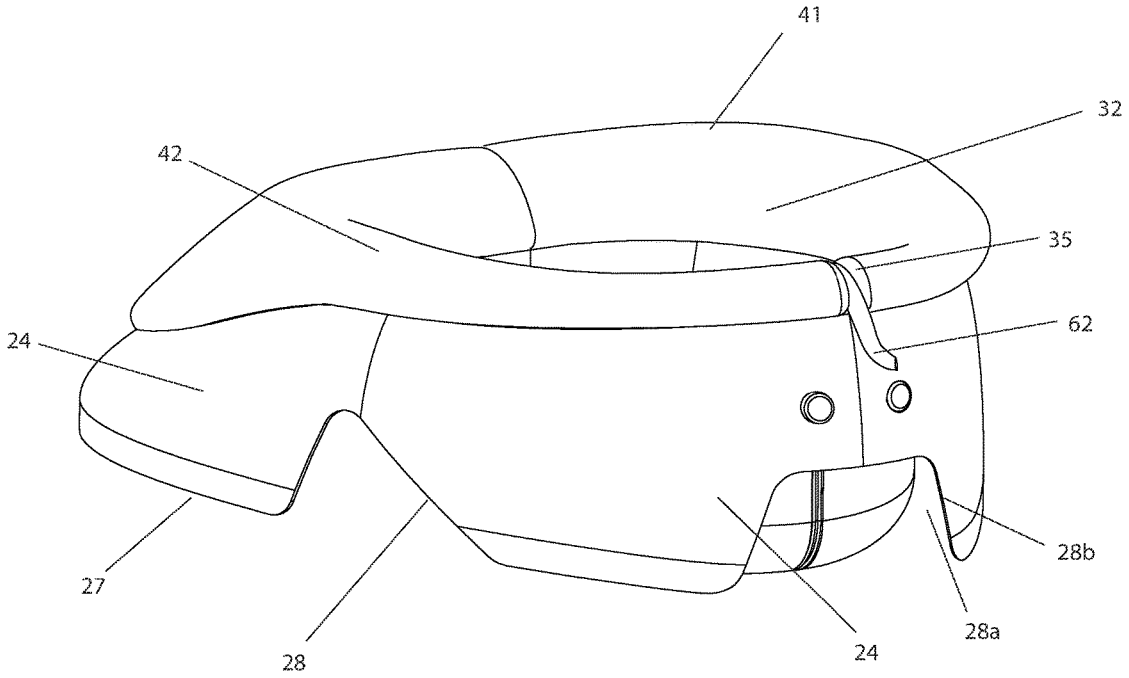
FIG. 5 is a side perspective view of assembled components according to one embodiment of the present invention.

Cushion assembly 450 includes first wall member 41, second wall member 42, that further define opening 30, and are joined at rear end 24 of assembly 20 along interface 35. Interface 35, as best seen in FIG. 5, in one embodiment, provides for a cavity for receiving access member 62 of assembly 200.

Figure 6:
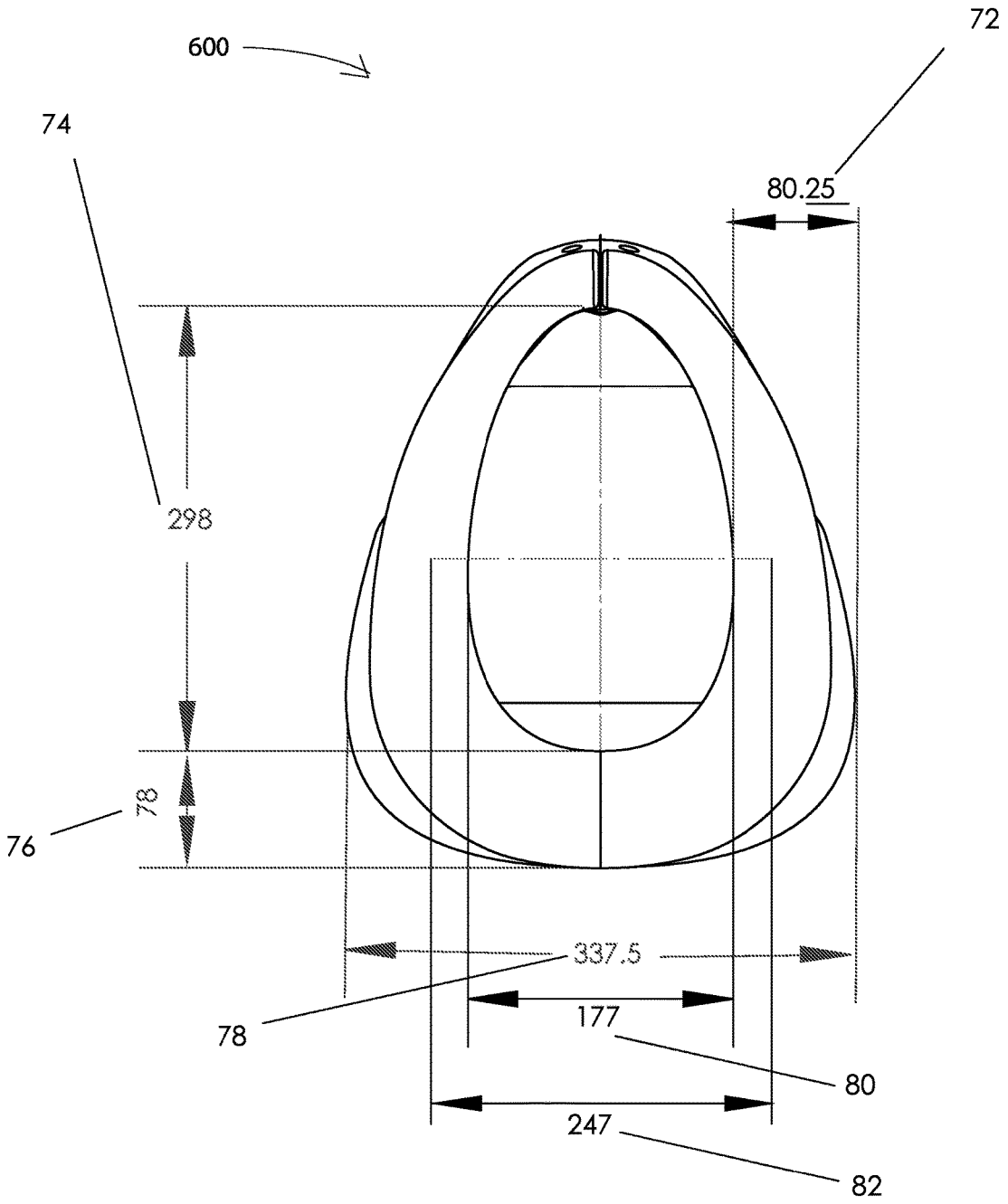
FIG. 6 is a top plan view demonstrative of one size configuration according to one embodiment of the present invention.

As demonstrated in FIG. 6, various dimensions are contemplated in the present invention. Dimension 72 indicates the length between the tangent line of the inner cavity opening to the outermost edge of assembly 20. Dimension 72 will be referred as side width. In a preferred embodiment, as demonstrated in FIG. 6, this length is about 80.25 millimeters. Dimension 74 indicates the length of the back to front distance of cavity opening 30. This dimension 74 is cavity length. A preferred embodiment has this length as 298 millimeters. Dimension 76 indicates the length from the rear wall 24 to the beginning of opening 30. This dimension 76 is rear surface length. In a preferred embodiment, this length is 78 millimeters. Dimension 78 indicates the largest horizontal distance across assembly 20. This dimension 78 is overall body width. This distance, in one embodiment, is 337.5 millimeters. Dimension 80 indicates the width of opening 30. This dimension 80 is cavity width. In one embodiment, this distance is 177 millimeters. Dimension 82 indicates the distance between congruous center points along assembly 20. This dimension 82 is central assembly distance. In one embodiment, this distance is 247 millimeters. Although particular distances are provided, the invention is set forth in the carefully engineered and constructed ratios that are present. The ratio of dimension 82:dimension 78 is about 1:1.25-1.45. The ratio of dimension 80:dimension 72 is about 1:0.4-0.5. The ratio of dimension 76:dimension 74 is about 1:3.5-4.0. Although there is similar look to conventional bed pans, these ratios are the result of significant measurement and research as set forth in 10-12 to determine an anatomically complementary structure.

Figure 7:
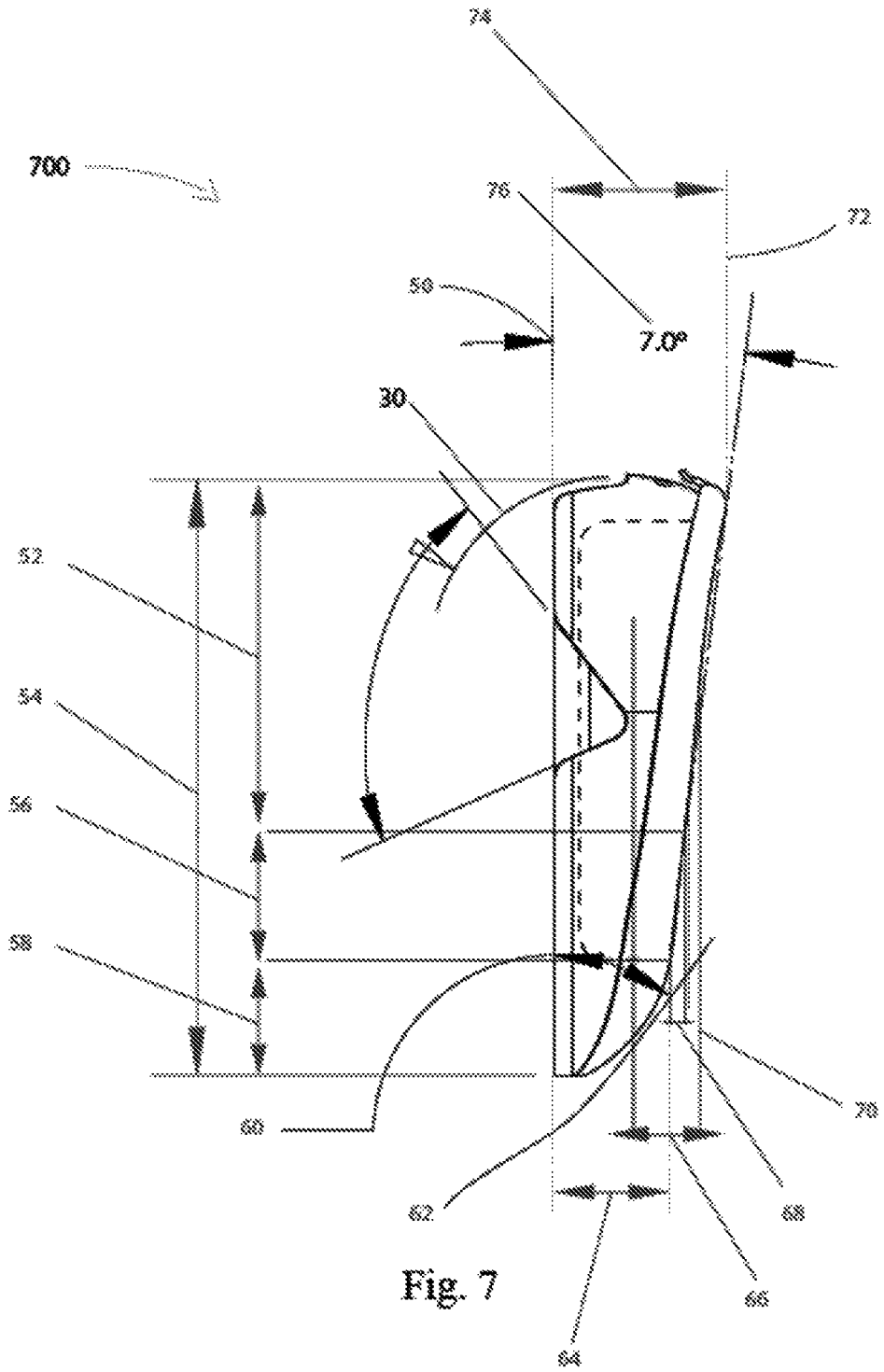
FIG. 7 is a side view from FIG. 6.

FIG. 7 is demonstrative of various angular configurations that are referred to as angle assemblies 700. Angle 84 is the rear elevation angle and indicates the angular elevation along a tangent line extending backward from rear wall 24 in relation to a line parallel to the horizontal plane in which housing 70 is resting. In one embodiment, this angle is 7 degrees. This is significantly less than in most conventional bedpans and is determined to impart a configuration having greater ease of use and comfort. Assembly 20 is constructed and arranged on either side with bay 28. Bay 28, in a preferred embodiment, forms a side bay angle 95 in itself of 76.3 degrees. That is to say, the opening is 76.3 degrees. In a preferred embodiment, dimension 90, indicating the overall length of assembly 20, is 415.7 millimeters. In a preferred embodiment, the curve of front end 22, in relation to the horizontal line defined by a substantially flat surface in which housing assembly 20 is places, is about 38.5 degrees.

In one embodiment, dimension 58 is initial downward curvature linear distance, dimension 56 is the linear distance in which there is angular elevation along the upper surface without curvature and dimension 52 is the linear distance encompassing the second or upward curvature. Dimension 54 is the overall length of the assembly. In one embodiment, the ratio of dimension 58:dimension 56:dimension 52 is about 1:0.9-1.1:4.8-5:2.

Also set forth in FIG. 7 are dimensions 87, overall height of assembly from highest point, dimension 170, vertical height at the end of first curvature 164, dimension 168, vertical height from horizontal central line to point 180, point 180 is the inflection point of second curvature, and dimension 168 vertical height from end of first curvature to inflection of second curvature.

An important ratio in engineering an anatomically synergistic assembly is the ratio of dimension 164:dimension 168 which is between about 1:0.05-0.10 and in one preferred embodiment, this ratio is between about 1:0.06-0.09.

Figure 8:
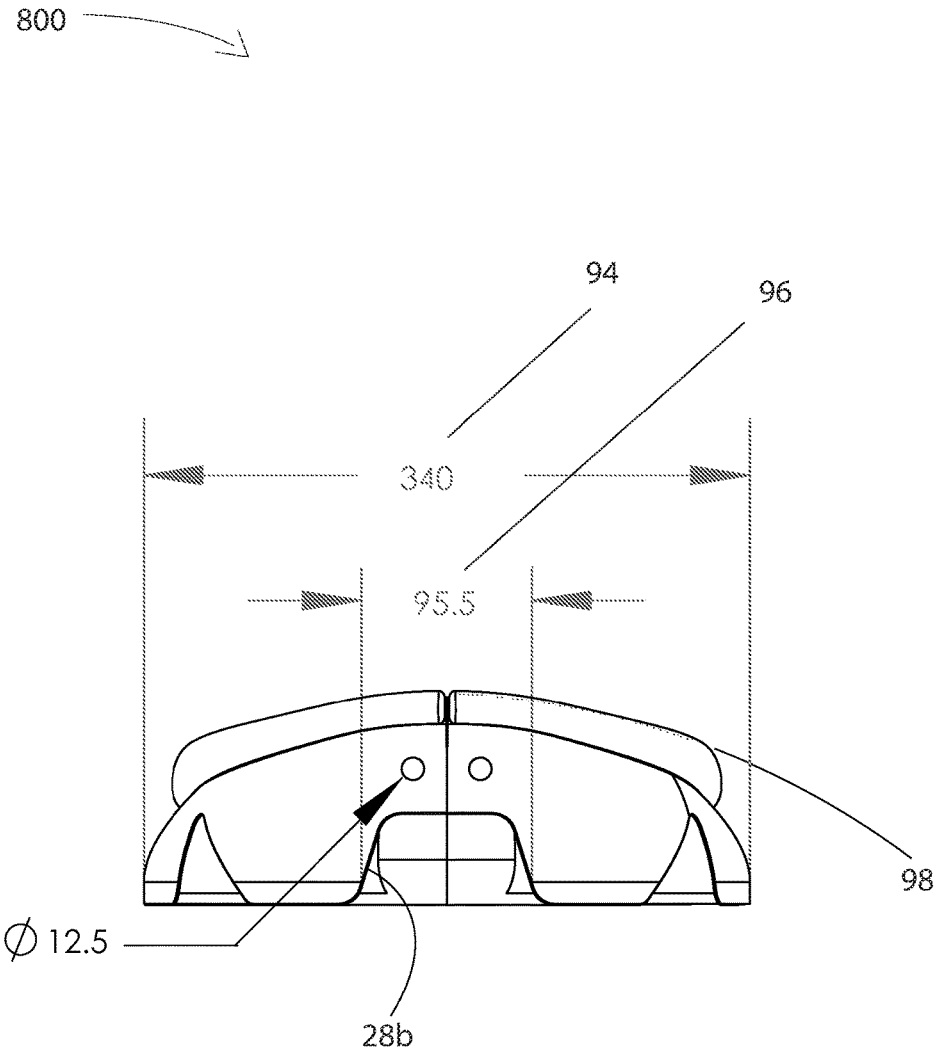
FIG. 8 is a rear view demonstrative of one configuration according to one embodiment of the present invention.
Figure 9:
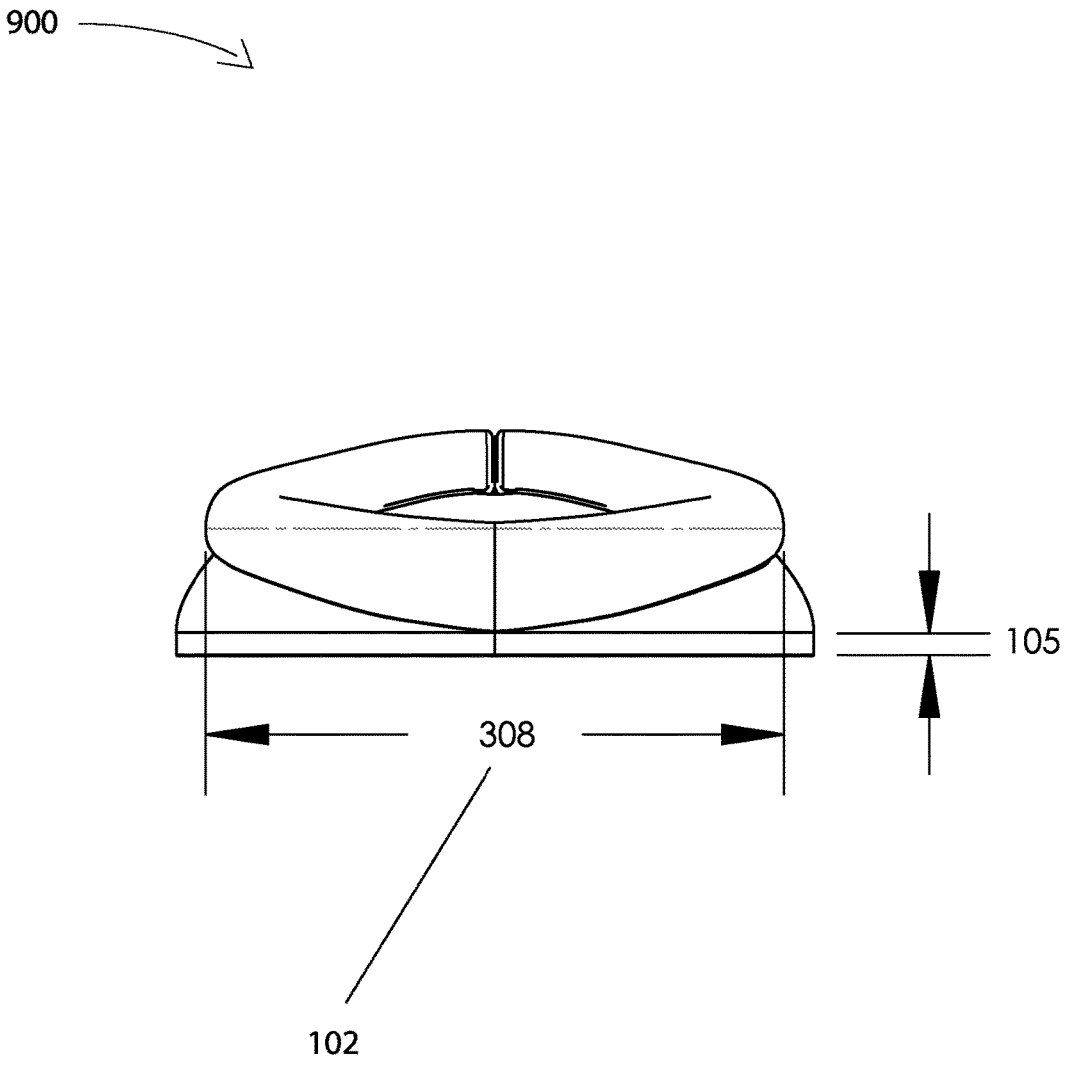
FIG. 9 is a partial front view according to one embodiment of the present invention.

In one embodiment, as demonstrated in FIG. 8, dimension 94, indicating the overall width of assembly 20, is 340 millimeters.

Dimension 96, indicating a preferred distance of rear bay 28, is 95.5 millimeters.

As discussed in FIG. 6, FIG. 7 distances are illustrative of ratios that are crucial to the anatomical complementary configuration of the present invention.

Figure 10:
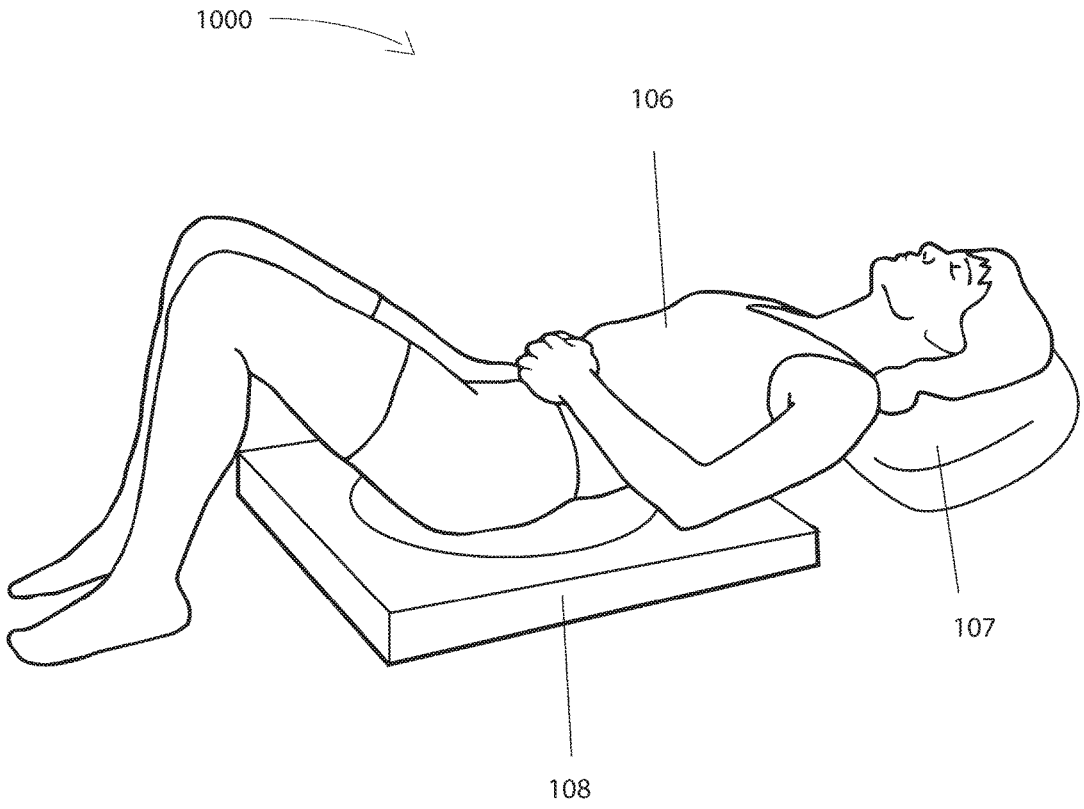
FIG. 10 is illustrative of one embodiment of use according to one embodiment of the present invention.
Figure 11:
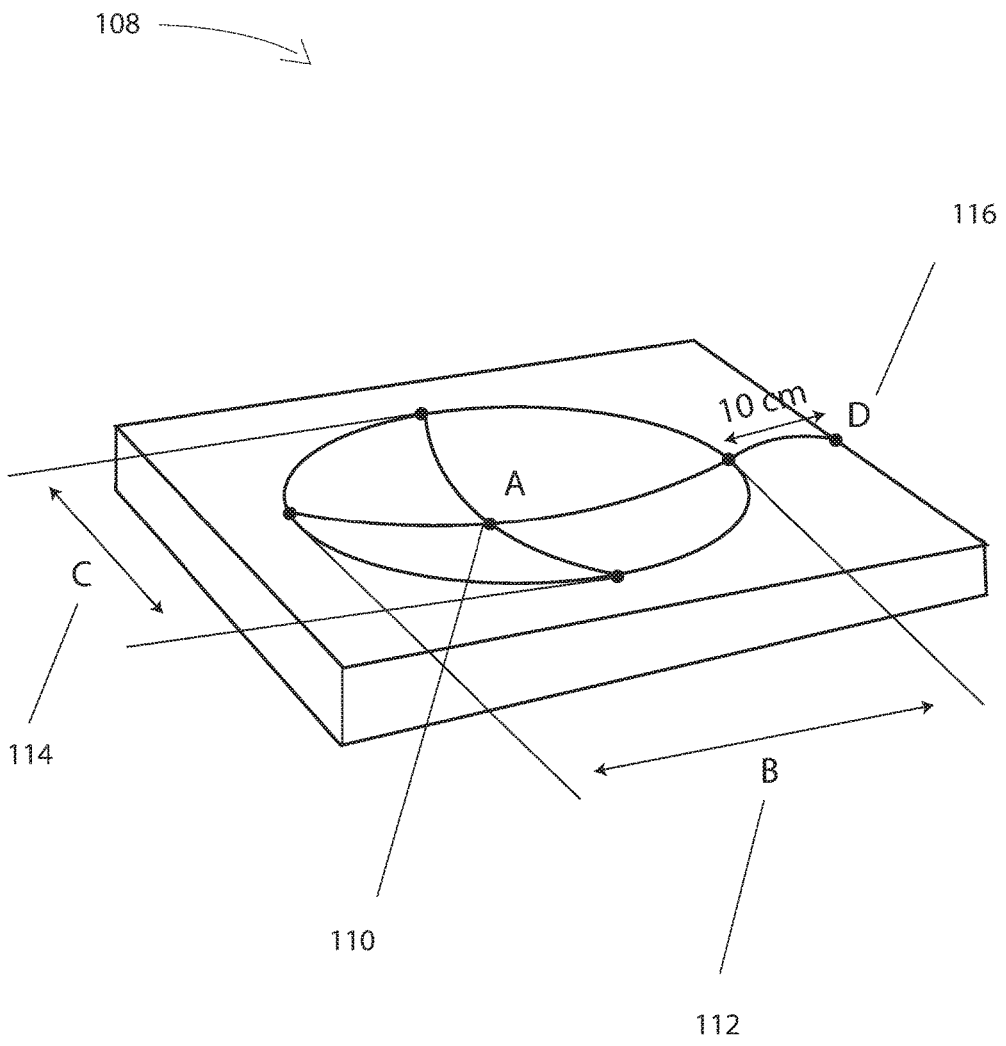
FIG. 11 is demonstrative of one configuration according to one embodiment of the present invention.
Figure 12:
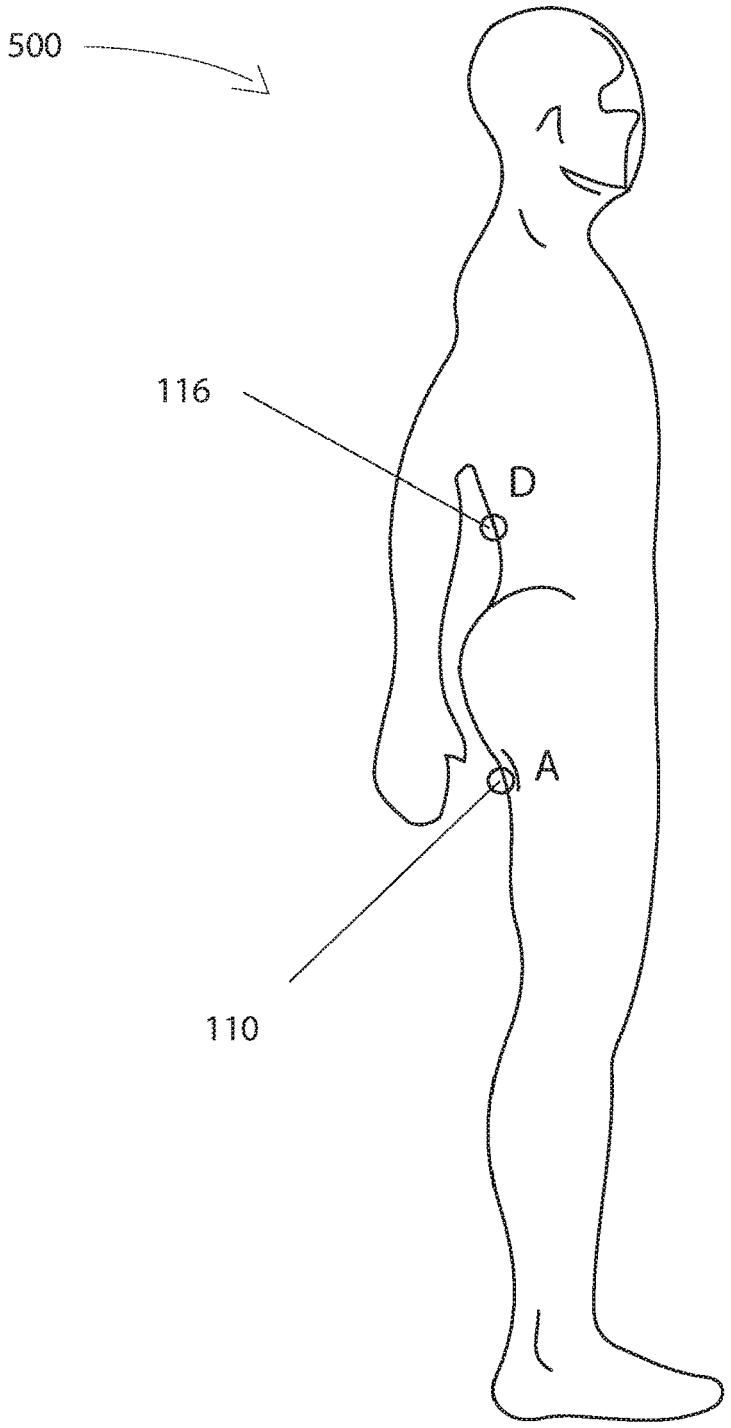
FIG. 12 is a side view of a person demonstrative of particular anatomical points considered in one embodiment of the present invention.

FIGS. 10-12 are illustrative of testing and results that led to the physical configuration and ratios discussed herein that provide an anatomically synergistic assembly.

Person 106 lies on pillow 107 and rests their bottom on assembly 108 in measurement arrangement 1000.

Measurements include measuring a persons central back 116 (point D) and inferior edge of their bottom or buttocks 110 (point A0.

In test assembly 108 point 110, point A, is the average point od greatest depth to fit the person's bottom and also have extra space for the person's extract. Dimension 112 is distance B being the length of the assembly current invention This is to ensure bottom fits with the open space plus have extra space for bigger individuals. Dimension 114 is distance C is width. Dimension 116 is distance D As shown in FIG. 6 the back width (dimension 76 of FIG. 6) to ensure a good back support for the user.

In use, liner assembly 200 will be placed within the inner cavity 31*a* of main housing assembly 20. As desired, power actuator 57 is initialized in order to selectively provide either a light indicator through light 56, a sound indicator through speaker 38, or both. In one embodiment, not shown, PCB board 55 further includes wireless communications means in transmission mode only to transmit to a configured receiver that sensor 48 has been actuated. A person 500 will lie on bedpan assembly 20 as is commonly done. When the person urinates and/or defecates, sensor 48 will actuate as configured.

While the invention has been described in its preferred form or embodiment with some degree of particularity, it is understood that this description has been given only by way of example and that numerous changes in the details of construction, fabrication and use, including the combination and arrangement of parts, may be made without departing from the spirit and scope of the invention.

What is claimed is:

1. A bedpan assembly comprising:

a main housing having a side wall and bottom wall defining a main housing interior cavity;

a flexible polymer-based liner assembly coupled to the main housing and having a bottom wall surrounded by sidewalls, the bottom wall and sidewalls including an inner surface defining an interior cavity for housing a fluid therein, the liner assembly disposed within the main housing interior cavity;

a sensor assembly including at least one sensor interposed between and adjacent to both the bottom wall of the liner assembly, outside of the interior cavity defined by the inner surface of the liner assembly, and the bottom wall of the main housing, the sensor assembly protected by and housed within a sensor protector assembly; and at least one of an audio indicator and a visual indicator operatively associated with said sensor to indicate, through actuation of either a sound or light of the least one of an audio indicator and a visual indicator, respectively, the presence of a weight of a fluid on the bottom wall of the liner assembly, whereby the actuation of either the sound or light provides a user an indication for removal of the liner assembly by uncoupling the liner assembly from the main housing.

2. The assembly of claim 1 constructed wherein said main housing has a rear elevation angle of about 6-10 degree, a front edge degree of curvature between about 30-40 degrees, and a non-curved surface immediately adjacent to said front end degree of curvature with an elevation of about 5-10 mm and free of any curvature.

3. The assembly of claim 1 wherein said sensor is operatively associated with at least one transmission device that is paired with at least one receiver configured for indicating said sensor being actuated.

4. The assembly of claim 1 including a pair of length edge bay structures congruently positioned along opposing lengths of said housing.

5. The assembly of claim 4 wherein each of said pair of length edge bay structures is constructed to form an angle between about 70 to 80 degrees.

6. The assembly of claim 1 including a rear bay structure having a width between about 90-100 mm.

7. The assembly of claim 1 wherein said housing has a width between about 300-360 mm.

8. A bedpan system comprising:

a main housing having a side wall and bottom wall defining a main housing interior cavity, said main housing constructed and arranged with a rear elevation angle of about 6-10 degree measured from a tangent line extending outward from a final rear point of said assembly, with an upper surface profile having a rear upward curvature, a front edge degree of curvature between about 30-40 degrees, and a non-curved surface between and immediately adjacent to said front end degree of downward curvature and said rear upward curvature, said noncurvature surface with an elevation of about 5-10 mm and free of any curvature, whereby the ratio of the linear distance of said front end downward curvature: non-curved surface: rear upward curvature is about 1:0.9-1.1:4.8-5.2;

a flexible polymer-based liner assembly coupled to the main housing and having a bottom wall surrounded by sidewalls, the bottom wall and sidewalls including an inner surface defining an interior cavity configured for placement and removal from said housing cavity, the liner assembly disposed within the main housing interior cavity;

a sensor assembly including at least one sensor interposed between and adjacent to both the bottom wall of the liner assembly, outside of the interior cavity defined by the inner surface of the liner assembly, and the bottom wall of the main housing, the sensor assembly of a weight sensor and protected by and housed within a sensor protector assembly;

at least one indicator actuatable by the presence of a weight of a fluid on the bottom wall of the liner assembly by said sensor and selected from the group consisting of a light indicator, a sound indicator, a transmitter associated with a remote receiver, or combinations thereof, wherein said indicator is controlled by a PCB board configured for actuating said indicator at the command of said sensor, whereby the actuation of the indicator provides a user an indication for removal of the liner assembly by uncoupling the liner assembly from the main housing;

a pair of length edge bay structures formed on and congruently positioned along opposing lengths of said housing, wherein each of said pair of length edge bay structures is constructed to form an angle between about 70 to 80 degrees;

a rear bay structure having a width between about 90-100 mm; and wherein said housing has a width between about 300-360 mm.

9. A bedpan assembly comprising:

a portable main housing having a side wall and bottom wall defining a main housing interior cavity surrounded by a cushion assembly, the cushion assembly defining an interface at a rear end of the main housing;

a flexible polymer-based liner assembly coupled to the main housing and having:

an upper edge defining an upper opening;

an inner surface disposed within the interior cavity of the main housing and defining an interior cavity spatially coupled to the upper opening of the liner assembly; and a receiving access member having a first end coupled to the upper edge of the flexible liner assembly, a second free end, opposing the first end, and a receiving access member length separating the first and second ends, the receiving access member disposed within the interface of the cushion assembly along the receiving access member length and the second free end of the receiving access member protruding from the cushion assembly for grasping by a user; and a sensor assembly including at least one sensor interposed between and adjacent to both the bottom wall of the liner assembly, outside of the interior cavity defined by the inner surface of the liner assembly, and the bottom wall of the main housing, the sensor assembly protected by and housed within a sensor protector assembly; and at least one of an audio indicator and visual indicator operatively associated with said sensor to indicate, through actuation of either a sound or light of the least one of an audio indicator and a visual indicator, respectively, the presence of a weight of a fluid on the bottom wall of the liner assembly, whereby the actuation of either the sound or light provides a user an indication for removal of the liner assembly by uncoupling the liner assembly from the main housing.

* * * * *